US005886634A

United States Patent [19]

Muhme

[11] Patent Number: 5,886,634

[45] Date of Patent: Mar. 23, 1999

[54] ITEM REMOVAL SYSTEM AND METHOD

[75] Inventor: Robert J. Muhme, Fraser, Mich.

[73] Assignee: Electronic Data Systems Corporation, Plano, Tex.

[21] Appl. No.: 851,221

[22] Filed: May 5, 1997

[51] Int. Cl.[6] ..... G08B 13/181

[52] U.S. Cl. ..... 340/572; 340/522; 340/568; 340/825.32; 340/825.34

[58] Field of Search ..... 340/568, 572, 340/522, 825.31, 825.32, 825.34, 825.35

[56] References Cited

U.S. PATENT DOCUMENTS

| | | | |
|---|---|---|---|
| 3,609,741 | 9/1971 | Miller | 340/539 |
| 4,006,459 | 2/1977 | Baker et al. | 340/825.31 |
| 4,853,692 | 8/1989 | Wolk et al. | 340/572 |
| 4,881,061 | 11/1989 | Chambers | 340/568 |
| 5,131,038 | 7/1992 | Puhl et al. | 380/23 |
| 5,260,690 | 11/1993 | Mann et al. | 340/572 |
| 5,396,218 | 3/1995 | Olah | 340/572 |
| 5,401,944 | 3/1995 | Bravman et al. | 235/375 |
| 5,583,486 | 12/1996 | Kersten | 340/568 |
| 5,650,768 | 7/1997 | Eswaran | 340/568 |
| 5,777,884 | 7/1998 | Belka et al. | 340/572 |

*Primary Examiner*—Glen Swann
*Attorney, Agent, or Firm*—Barton E. Showalter; L. Joy Griebenow

[57] ABSTRACT

A security system includes a base station that reads a first tag and a second tag, each tag associated with items, persons, and/or containers. Upon reading the tags, the base station determines whether the removal of the items, persons, and/or containers is authorized. If the removal is not authorized, the base station may activate an alarm, lock the exit, and/or generate a message for delivery to a remote site. The security system may also be integrated with an inventory control system to monitor the location and status of the items, persons, and/or containers.

20 Claims, 5 Drawing Sheets

ITEM REMOVAL SYSTEM AND METHOD

TECHNICAL FIELD OF THE INVENTION

This invention relates to the field of security systems, and more particularly to an item removal system and method.

BACKGROUND OF THE INVENTION

Many organizations maintain security systems and procedures that provide controlled access to the organizations' facilities. Primarily, these security systems and procedures focus on the movements of people. For example, an organization may place security systems at the vehicle or personnel entrances of the facilities to detect the egress and ingress of unauthorized personnel. Such systems employ security guards or automated devices such as badge or card readers to control access to facilities. An automated device may incorporate bar coding, magnetic stripe reading, retinal scanning, finger printing, or other known technique to retrieve information from the identification badge or authorized person.

These existing security systems may not adequately protect valuable items associated with personnel with access to the facility. For example, computing equipment, communications equipment, magnetic tapes, and other valuable or sensitive items may be stolen by persons with access to the facilities but without the authority to remove the items from the facilities.

SUMMARY OF THE INVENTION

In accordance with the present invention, an item removal system and method are provided that substantially eliminate or reduce disadvantages or problems associated with previously developed security systems and methods. In particular, the present invention provides a system and method for authorizing the removal of an item from a facility by associating the item with an authorized person, an authorized container, or both.

In one embodiment of the present invention, a system for authorizing the removal of an item from a facility includes a first tag affixed to the item and a second tag in proximity to the item. A reader reads the first tag and the second tag, and a database coupled to the reader indicates an association between the first tag and the second tag to authorize the removal of the item from the facility. In more particular embodiments, the second tag may be associated with a person transporting the item or affixed to a container transporting the item.

Technical advantages of the present invention include a security system that tags valuable or confidential items, as well as the persons or containers that transport those items. For example, a person with a tag may attempt to exit the facility with a laptop computer that also contains a tag. The security system reads the two tags, consults a database, and determines if removal of the item from the facility is authorized. Any number and combination of items, persons, and containers may be tagged and associated to provide adequate monitoring of the removal of items from a facility. In a particular embodiment, the security system includes a base station that reads tags on items, persons, and/or containers, and determines whether the tags are properly associated and whether the corresponding items, persons, and/or containers are authorized to exit the facility. The base station may lock doors, sound alarms, and/or communicate a message to a remote site or security outpost that includes information on the unauthorized exit.

Another technical advantage of the present invention is the use of wireless transmissions to read tags in a person's pocket, within valuable items, enclosed in boxes, or in some other inaccessible or concealed location. This provides convenience to the persons using the security system, and heightens security since tags may be embedded or concealed within items. The security system may set a predetermined time interval that defines an authorization event. During this authorization event, the system reads tags within its range to reduce or eliminate "tailgating" and other techniques designed to foil the system.

Yet another technical advantage of the present invention is the integration of a base station with the organization's inventory control system. The inventory control system can maintain, update, and modify associations between items, persons, and/or containers and communicate this information to the base station to provide immediate and dynamic control over items in the facility. The base station may communicate egress and ingress information to the inventory control system to update the location and status of items, persons, and/or containers. Other technical advantages are readily apparent to one skilled in the art from the following figures, descriptions, and claims.

BRIEF DESCRIPTION OF THE DRAWINGS

For a more complete understanding of the present invention, and for further features and advantages thereof, reference is now made to the following description taken in conjunction with the accompanying drawings, in which.

DETAILED DESCRIPTION OF THE INVENTION

Figure 1:
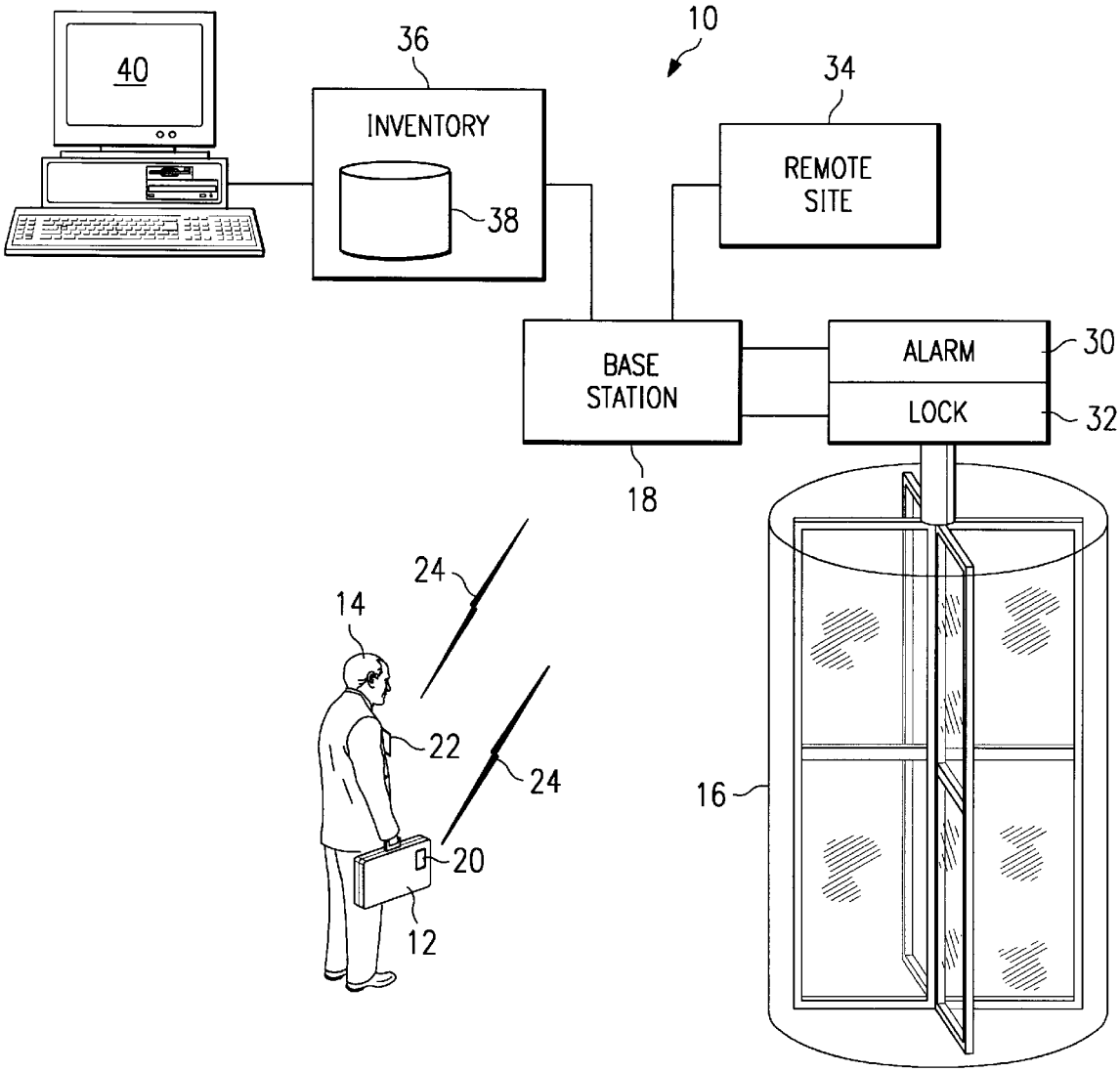
FIG. 1 illustrates a security system that authorizes the removal of an item from a facility according to the present invention.

FIG. 1 illustrates a security system 10 that authorizes the removal of an item 12 from a facility. In this embodiment, a person 14 transports item 12 from the facility through an exit 16. The security system 10 includes a base station 18 that communicates with tag 20 associated with item 12 and tag 22 associated with person 14 to authorize the removal of item 12 by person 14.

Item 12 may be any portable item of which an organization desires to prevent unauthorized removal from its facility. This may include computing equipment (e.g., laptop computers, desktop computers, calculators, personal information managers), communications equipment (e.g., telephones, facsimile machines, modems), portable computer media (e.g., magnetic disks, optical disks, backup tapes), or other valuable and confidential items that are subject to potential unauthorized removal. Each item 12 to be monitored includes tag 20 mounted on the surface of item 12, enclosed or embedded within item 20, or otherwise affixed to item 12. For example, tag 20 may be enclosed within the casing of a laptop computer to heighten the security features and capabilities of system 10.

Person 14 also includes tag 22 that may be incorporated or integral to an employee identification badge or device maintained on person 14 or in proximity to person 14. For example, a badge may be clipped to or enclosed in a pocket, carried in the employee's wallet or purse, transported in another personal article (e.g., brief case, luggage), surgically implanted or affixed to person 14, or otherwise placed in proximity to person 14.

Wherever tags 20 and 22 are placed, enclosed, or positioned, base station 18 utilizes wireless communication techniques to read information encoded or stored within tags 20 and 22. In a particular embodiment, base station 18 transmits an interrogation message or request to read tags 20 and 22, and tags 20 and 22 respond by transmitting a response message to base station 18 that includes their respective tag identifiers (IDs). Base station 18 and tags 20 and 22 preferably communicate over links 24 using any appropriate wireless communication technique, such as radio frequency (RF), infrared (IR), optical, ultrasound, or other wireless technique that allows base station 18 to interrogate and receive the tag IDs of tags 20 and 22.

Base station 18 is coupled to alarm 30 which includes audible alarms, visual alarms, and/or other alarm devices for activation when base station 18 detects an unauthorized attempt to remove item 12 from the facility. Lock 32 is coupled to base station 18 and operates with exit 16 to prevent the unauthorized removal of item 12. Exit 16 may be one or a combination of the following: doors, revolving doors, gates, turnstiles, openings, or other egress or ingress locations. In a particular embodiment, exit 16 is a turnstile or revolving door and lock 32 controls the rotation of exit 16 to entrap person 14, if base station 18 detects an unauthorized exit.

Base station 18 may also communicate an alarm condition, tag IDs, information on item 12 and person 14, and other information regarding the authorization event to remote site 34 to alert security officers or other authorities of the unauthorized successful or attempted removal of item 12. Base station 18 is also coupled to inventory control system (ICS) 36 that includes inventory database 38. ICS 36 is coupled to an interface 40 that allows entry and modification of information stored in database 38 related to item 12 and person 14 authorized to remove item 12 from the facility. Base station 18 provides egress and ingress information to ICS 36 as it processes authorization events at exit 16. Interface 40 accesses database 38 in ICS 36 to retrieve egress and ingress information for monitoring the movements of items 12 and persons 14 throughout an organization's facility.

In operation, ICS 36 receives information regarding the association between item 12 and person 14 from interface 40. ICS 36 stores this information in database 38 and, alternatively or in addition, transmits this information to base station 18. Periodically, ICS 36 receives additional information regarding the association between items 12 and persons 14 in security system 10. ICS 36 then updates database 38 and informs base station 18 of the changes as needed. In this described example, ICS 36, base station 18, or both maintain information that associates item 12 with person 14.

Person 14 transporting item 12 approaches exit 16 and comes within wireless communication range of base station 18. Base station 18 continually or periodically transmits interrogation messages to detect the presence of tags 20 and 22 within its wireless communication range. Base station 18 may also initiate transmission of an interrogation message upon an alternative detection of the presence of item 12 and person 14 by an optical beam, motion sensor, user-operated button, or other suitable device. Using any of these initiation techniques or devices, base station 18 transmits an interrogation message and tags 20 and 22 communicate a response message using links 24. The response message includes tag IDs of tags 20 and 22. Base station 18 then consults a local database or database 38 in ICS 36 to determine if person 14 is authorized or properly associated with item 12. If base station 18 determines that person 14 is authorized to remove item 12 from the facility, base station 18 deactivates lock 32 to allow person 14 to pass through exit 16.

However, if base station 18 determines that person 14 is not authorized to remove item 12 from the facility, base station 18 declares an unauthorized exit. In a particular embodiment, base station 18 activates alarm 30 and lock 32 to prevent the removal of item 12 by person 14. Also, base station 18 may generate and communicate a message to remote site 34 that contains relevant information on the unauthorized exit. This information may include tag IDs of tags 20 and 22, additional information retrieved from a local database or database 38 regarding item 12 and person 14, an identification of exit 16, and other information that allows persons or systems located at remote site 34 to respond and investigate the unauthorized exit.

Figure 2:
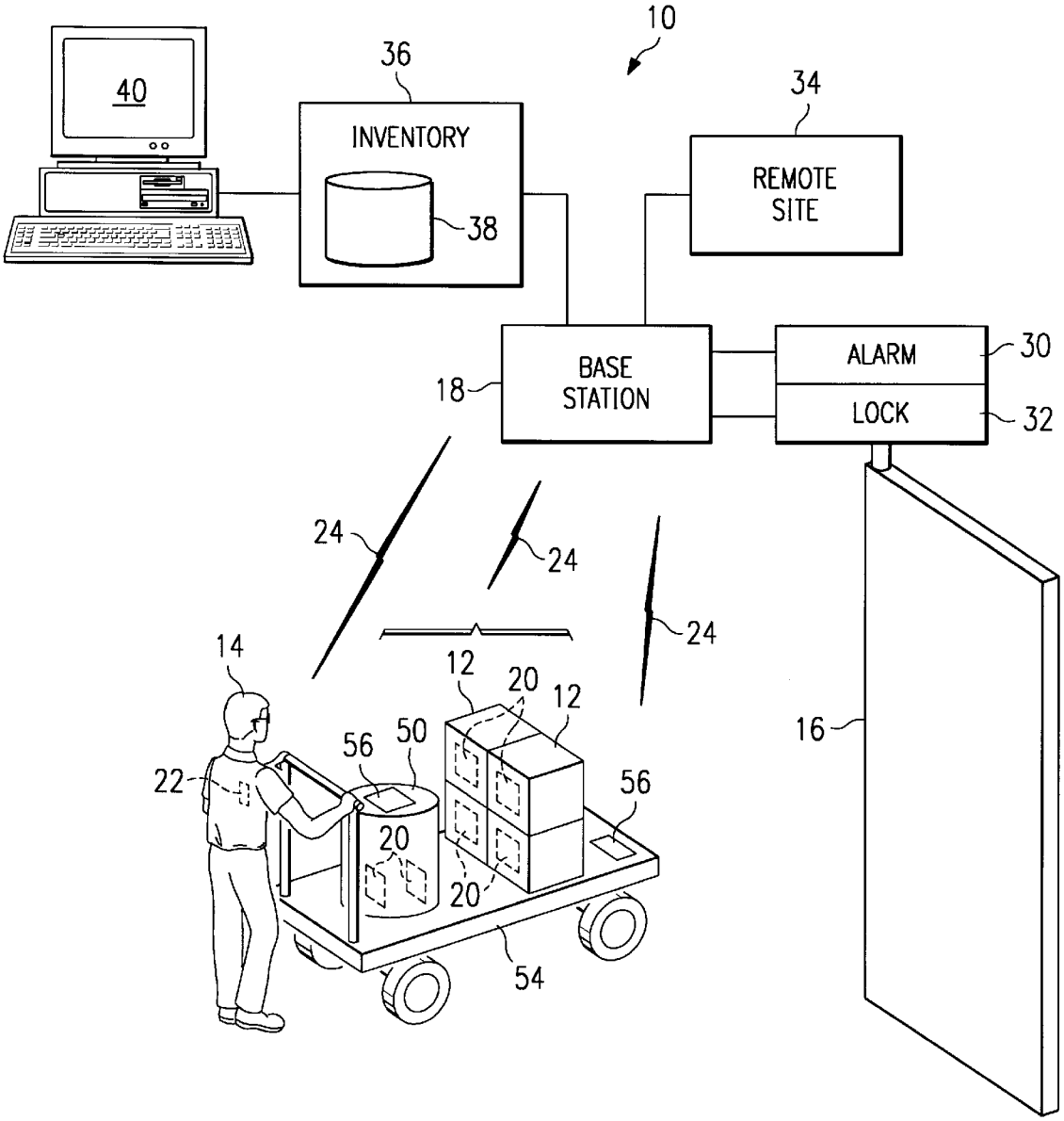
FIG. 2 illustrates an alternative embodiment of a security system that authorizes the removal of an item from a facility according to the present invention.

FIG. 2 illustrates an alternative embodiment of security system 10 that includes various containers 50 and 54 (referred to generally as containers 50) to transport items 12. Containers 50 include container tags 56, which provide additional flexibility to authorize the removal of items 12 in security system 10. Containers 50 may be boxes, crates, carts, personal vehicles, trucks, forklifts, or any other device that can transport item 12, person 14, or both.

In one embodiment, container 50 includes container tag 56 that is associated with tags 20 of items 12 contained within container 50. This arrangement allows for certain tagged containers 50 to be self-authorizing for the removal of items 12. For example, relocation personnel, inventory control personnel, and management information systems (MIS) personnel may use self-authorizing containers 50 to transport associated items 12 throughout and between the organization's facilities. In another embodiment, container 54 includes container tag 56 associated with tags 20 of items 12 carried by container 54. For example, container 54 may be a dolly, cart, or other device used to transport items 12. Person 14 carrying or otherwise transporting containers 50 and 54 containing items 12 may include tag 22 associated with tags 20, tags 56, or both.

In operation, person 14, with or without tag 22, carries or transports containers 50 to exit 16. As items 12, person 14, and containers 50 approach exit 16, base station 18 interrogates and receives tag IDs from tags 20, 22, and/or 56, respectively. Base station 18 consults a local database or database 38 in ICS 36 to determine the proper association among items 12, person 14, and/or containers 50. Base station 18 then proceeds in the manner described above with reference to FIG. 1 to handle an authorized or unauthorized exit.

Figure 3:
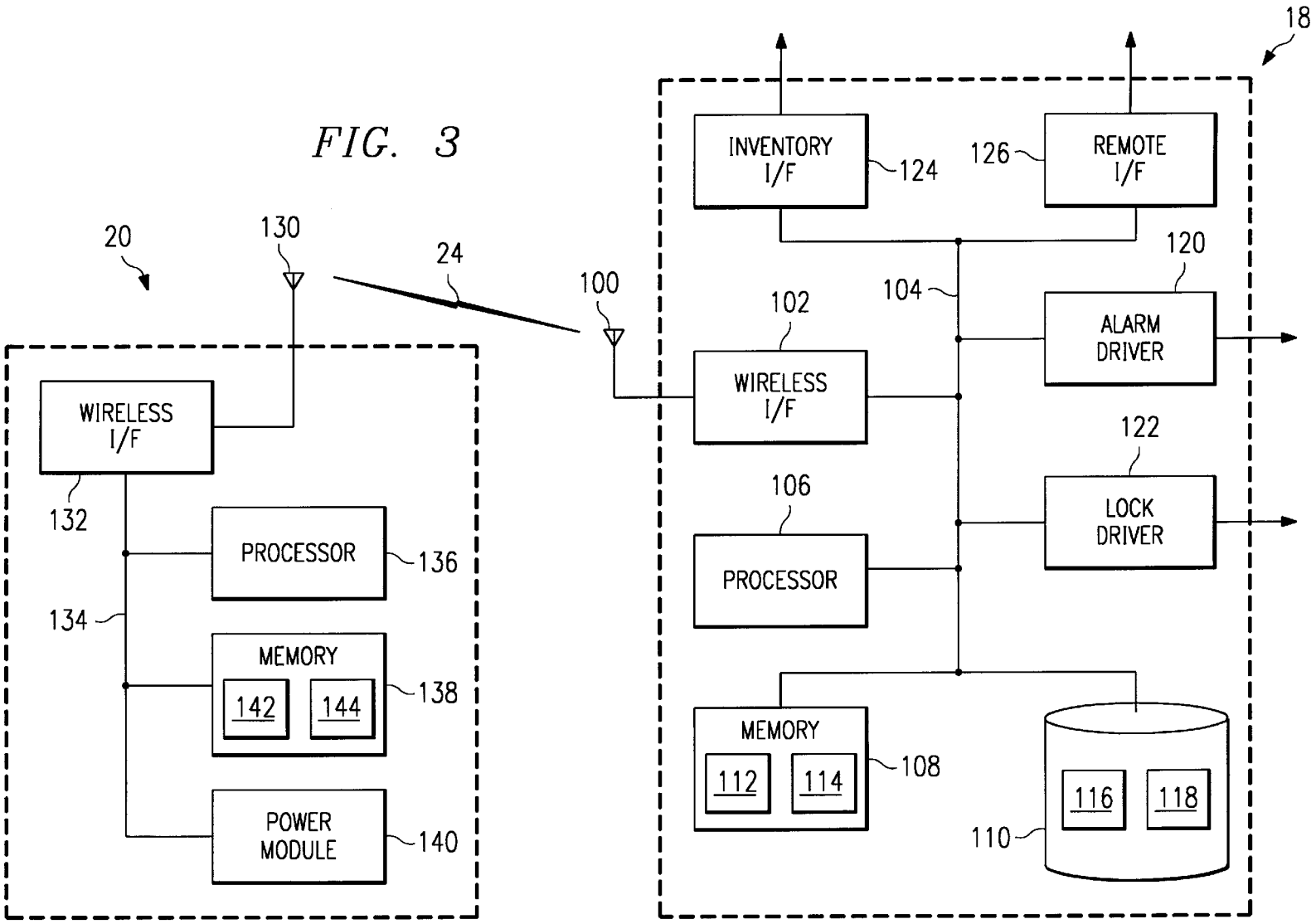
FIG. 3 illustrates a schematic block diagram of an exemplary base station and tag used in the security system according to the present invention.

FIG. 3 illustrates a schematic block diagram of base station 18 and tag 20. Tag 20 refers to tags 20 on items 12, tags 22 on persons 14, and tags 56 on containers 50, which are all similar in structure and functionality. Although FIG. 3 illustrates a single base station 18 and a single tag 20, it should be understood that security system 10 may include multiple base stations 18 at a single or multiple exits 16 to service any combination of tags 20.

Base station 18 includes an antenna 100 coupled to a wireless interface 102. Antenna 100 and wireless interface 102 together comprise a reader that communicates with tags 20 using link 24 and any suitable wireless technique. Wireless interface 102 is coupled to bus 104, which in turn is coupled to a processor 106 and a memory 108. Memory 108 includes program instructions 112 executed by processor 106 to control the overall operation and function of base station 18. Memory 108 also includes tag ID list 114 that stores tag IDs received by base station 18 during an authorization event. A database 110 is also coupled to bus 104 and includes an associated tag ID list 116 that establishes an association among tags 20 in security system 10. Tag ID list 114 and associated tag ID list 116 are described in more detail below with reference to FIG. 5. Database 110 also includes a log 118 to store information on authorization events performed by base station 18.

Base station 18 also includes an alarm driver 120 and a lock driver 122 coupled to bus 104. Alarm driver 120 allows base station 18 to activate visual, audible, and/or other alarms at exit 16. Lock driver 122 allows base station to lock and unlock exit 16. Lock driver 122 may also include additional circuitry to sense the position or status of exit 16 and to lock person 14 in exit 16 in response to an unauthorized exit. This may be particularly advantageous when exit 16 is a revolving door or turnstile or when exit 16 comprises an inner and outer door that define a secure area to trap unauthorized person 14.

Base station 18 also includes an inventory interface 124 and a remote site interface 126 coupled to bus 104. Inventory interface 124 and remote site interface 126 may support communication over a local area network (LAN), wide area network (WAN), public switched telephone network (PSTN), wireless communication link, or other dedicated, switched, private, or public communication link. Inventory interface 124 allows base station 18 to communicate with ICS 36. In this manner, base station 18 may access database 110 or database 38 in ICS 36 to determine whether an exit is authorized. Inventory interface 124 allows ICS 36 to update the contents of associated tag ID list 116 stored in database 110. Inventory interface 124 also allows base station 18 to communicate egress and ingress information to ICS 36 to update the location and status of items 12, persons 14, and containers 50 in the organization's facilities.

Remote site interface 126 allows base station 18 to communicate an alarm message and other information concerning the operation of base station 18 to remote site 34. The alarm message may include tag IDs stored in tag ID list 114; information maintained in associated tag ID list 116 or log 118; information related to items 12, persons 14, and containers 50; the identification or location of exit 16; or other information regarding the authorization event or unauthorized exit. Since log 118 stores information on previous authorization events performed by base station 18, the alarm message may include information on preceding or subsequent authorization events to frustrate attempts to remove items 12 by tailgating with an otherwise authorized exit. In one embodiment, remote site 34 comprises a manned security station, police station, or other site that contains authorized personnel to investigate the unauthorized exit detected by base station 18.

Tag 20 in FIG. 3 includes an antenna 130 and a wireless interface 132 that operate to communicate information with base station 18 using link 24. Wireless interface 132 is coupled to bus 134, which in turn is coupled to a processor 136, a memory 138, and a power module 140. Processor 136 directs the overall operation of tag 20, and may comprise an application-specific controller that coordinates components of tag 20 to respond to an interrogation message from base station 18.

Memory 138 may comprise random access memory (RAM), read only memory (ROM), or other suitable volatile or non-volatile memory. Memory 138 includes program instructions 142 executed by processor 136 to control the overall operation and function of tag 20. Memory 138 also includes a tag ID 144 that distinctly identifies tag 20. Power module 140 provides power to components of tag 20 to generate and transmit a response message to base station 18. Power module 140 may comprise a battery or other power storage device. Power module 140 may also include circuitry that receives power from the interrogation signal from base station 18 to energize circuits of tag 20 to transmit a response message.

In operation, tag 20 moves to within the wireless operating range of base station 18 and receives an interrogation signal at antenna 130 and wireless interface 132. Processor 136 detects the interrogation signal and generates a response message using the contents of memory 138. In a particular embodiment, the response message comprises tag ID 144 and any suitable framing, synchronization, error correction, or protocol information of the chosen transmission technique of link 24. Moreover, the response message may be encrypted to prevent unauthorized interception of tag ID 144. Wireless interface 132 receives the response message generated by processor 136 and places the response message into a suitable form for transmission over antenna 130. This may include appropriate generation of a carrier signal and the use of a variety of analog or digital modulation techniques to impress the information contained in the response message on a suitable wireless communication channel supported by link 24. Powered by power module 140, wireless interface 132 and antenna 130 transmit the response message to base station 18 using link 24.

Antenna 100 and wireless interface 102 receive and demodulate the response message at base station 18. If appropriate, wireless interface 102 and/or processor 106 may retrieve a key or encryption algorithm to decode the transmission and recover the information in the response message. Processor 106 then directs memory 108 to store tag ID 144 received from tag 20 in tag ID list 114. Base station 18 may receive responses from other tags 20, and their associated tag IDs 144 are also stored in tag ID list 114 in a similar manner.

Processor 106 then determines if a predetermined time interval defining an authorization event has expired. Upon expiration of the predetermined time interval, processor 106 queries associated tag ID list 116 stored in database 110 to determine if tag IDs 144 stored in tag ID list 114 are authorized to exit the facility. If the exit is authorized, processor 106 directs lock driver 122 to unlock exit 16. Processor 106 then records information associated with the authorization event in log 118 of database 110.

If the exit is unauthorized, processor 106 directs lock driver 122 to lock exit 16, which in the case of a revolving door or inner/outer door configuration may confine person 14 in exit 16. Processor 106 also directs alarm driver 120 to activate appropriate alarms 30 and may generate and direct an alarm message to remote site 34 using remote site interface 126. Processor 106 then records information associated with the authorization event in log 118 of database 110.

Figure 4:
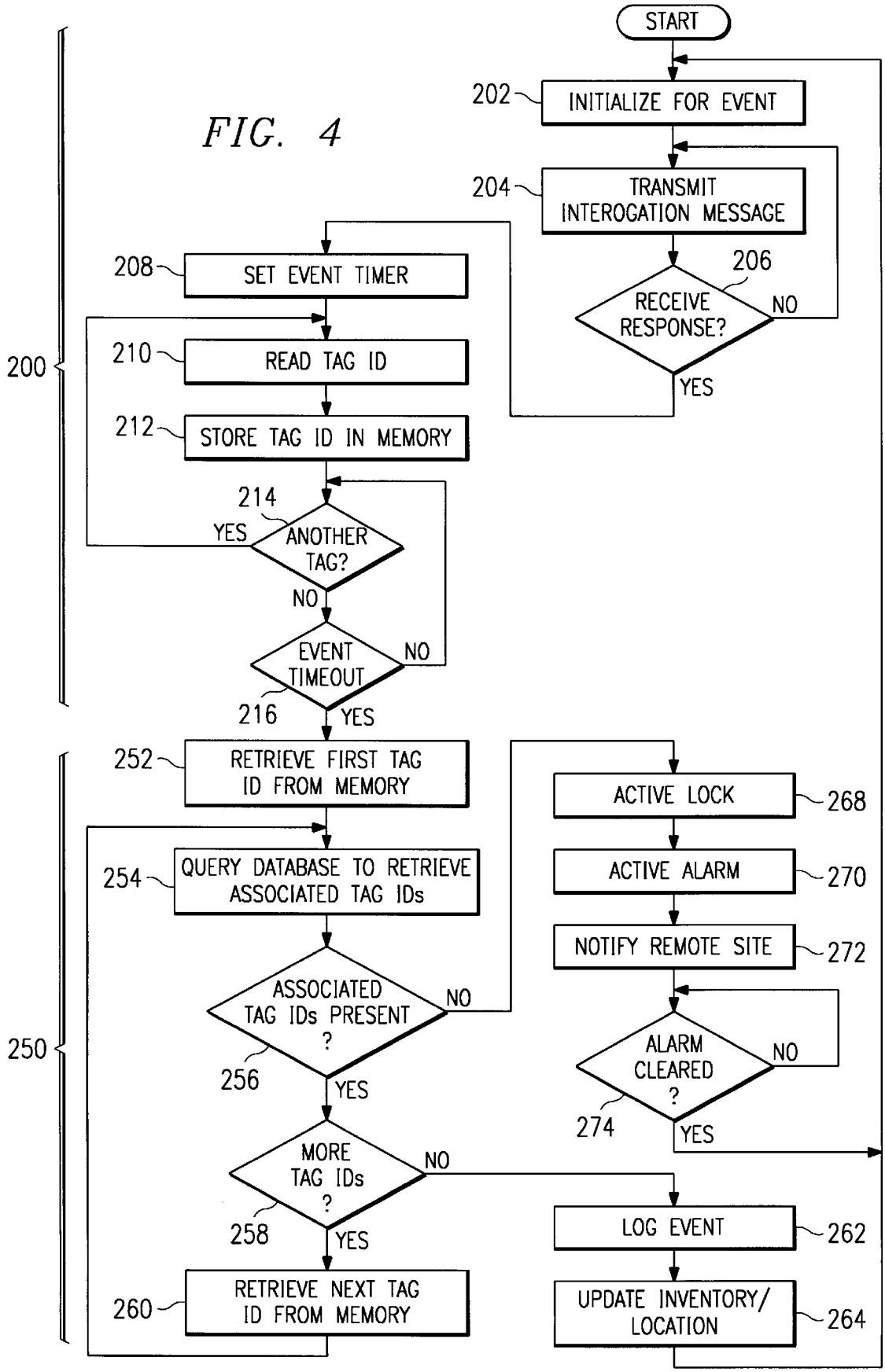
FIG. 4 is a flow chart of an exemplary method for operating a base station in the security system according to the present invention.

FIG. 4 is a flowchart of a method of operation of base station 18 in security system 10. The method includes a section 200 to collect tag IDs 144 and a section 250 to determine whether the collected tag IDs 144 are authorized to exit. The method begins at step 202 where base station 18 initializes for a new authorization event, which may include clearing tag ID list 114 in memory 108. Either periodically or in response to an initiation event (e.g., breaking an optional beam, activating a motion sensor) base station 18 transmits an interrogation message over link 24 using antenna 100 and wireless interface 102 at step 204. As long as base station 18 does not receive a response to the interrogation message from tag 20 at step 206, base station 18 continues to repeat the transmission of an interrogation message at step 204.

Upon receiving a response message from tag 20 as determined at step 206, base station 18 sets an event timer at step 208. The event timer measures a predetermined time interval in which an authorization event is to occur. Base station 18 interrogates and receives responses from tags 20 in a predefined time window that defines the authorization event. Since the authorization event occurs within a specified time window, base station 18 specifies one or more items 12, persons 14, and/or containers 50 that together are to be authorized before exiting the facilities. By defining a specific time window (e.g., five seconds) base station 18 frustrates efforts to "tailgate" or follow closely behind other items 12, persons 14, and/or containers 50. For example, a person carrying a laptop computer may attempt to follow closely behind another person authorized to remove the same laptop computer. Base station 18 can prevent these attempts to foil system 10 by defining a narrow time window or by limiting the number of items 12, persons 14, and/or containers 50 for each authorization event. For example, base station 18 may not allow removal of items 12 if more than one person 14 is present at the authorization event.

Base station 18 reads tag ID 144 from the response message at step 210 and stores tag ID 144 in tag ID list 114 at step 212. If base station 18 detects a response message from another tag 20 at step 214, then steps 210 and 212 are repeated to store additional tag IDs 144 in tag ID list 114 of memory 108. The collection of tag IDs 144 present in the operating range of base station 18 continues as long as processor 106 does not indicate an event timeout at step 216. After determining that an event timeout has occurred at step 216, tag ID list 114 contains all collected tag IDs 144 for the authorization event.

The method of FIG. 4 then proceeds to section 250 to evaluate tag IDs 144 collected by base station 18 and stored in tag ID list 114. Section 250 begins at step 252 where processor 106 retrieves the first tag ID stored in tag ID list 114. Processor 106 queries associated tag ID list 116 in database 110 to retrieve associated tag IDs of the first tag ID at step 254. Processor 106 then determines if all associated tag IDs are present in tag ID list 114 at step 256.

If all associated tag IDs are present at step 256, then base station 18 determines if there are more tags to retrieve from tag ID list 114 at step 258. The method then proceeds to retrieve the next tag ID from tag ID list 114 at step 260 and repeats steps 254 and 256 to determine if all associated tag IDs are present for the next tag ID. This operation continues until base station 18 confirms that all associated tag IDs are present for each tag ID 144 stored in tag ID list 114. If no more tag IDs 144 in tag ID list 114 are to be processed as determined at step 258, base station 18 logs information about the authorization event in log 118 at step 262. Base station 18 may also communicate a message using inventory interface 124 to update ICS 36 and its associated database 38 with the new location and status information of items 12, persons 14, and containers 50 associated with tag IDs 144 at step 264. The method proceeds to initialize for another authorization event at step 202.

If all associated tag IDs are not present at step 256, then processor 106 directs lock driver 122 to activate lock 32 of exit 16 at step 268 and preferably directs alarm driver 120 to active alarm 30 at step 270. Base station 18 then generates and communicates an alarm message to remote site 34 using remote site interface 126 at step 272. If the alarm condition is cleared by base station 18, remote site 34, or other authorized personnel or system at step 274, then the method proceeds to initialize for another authorization event at step 202.

Figure 5:
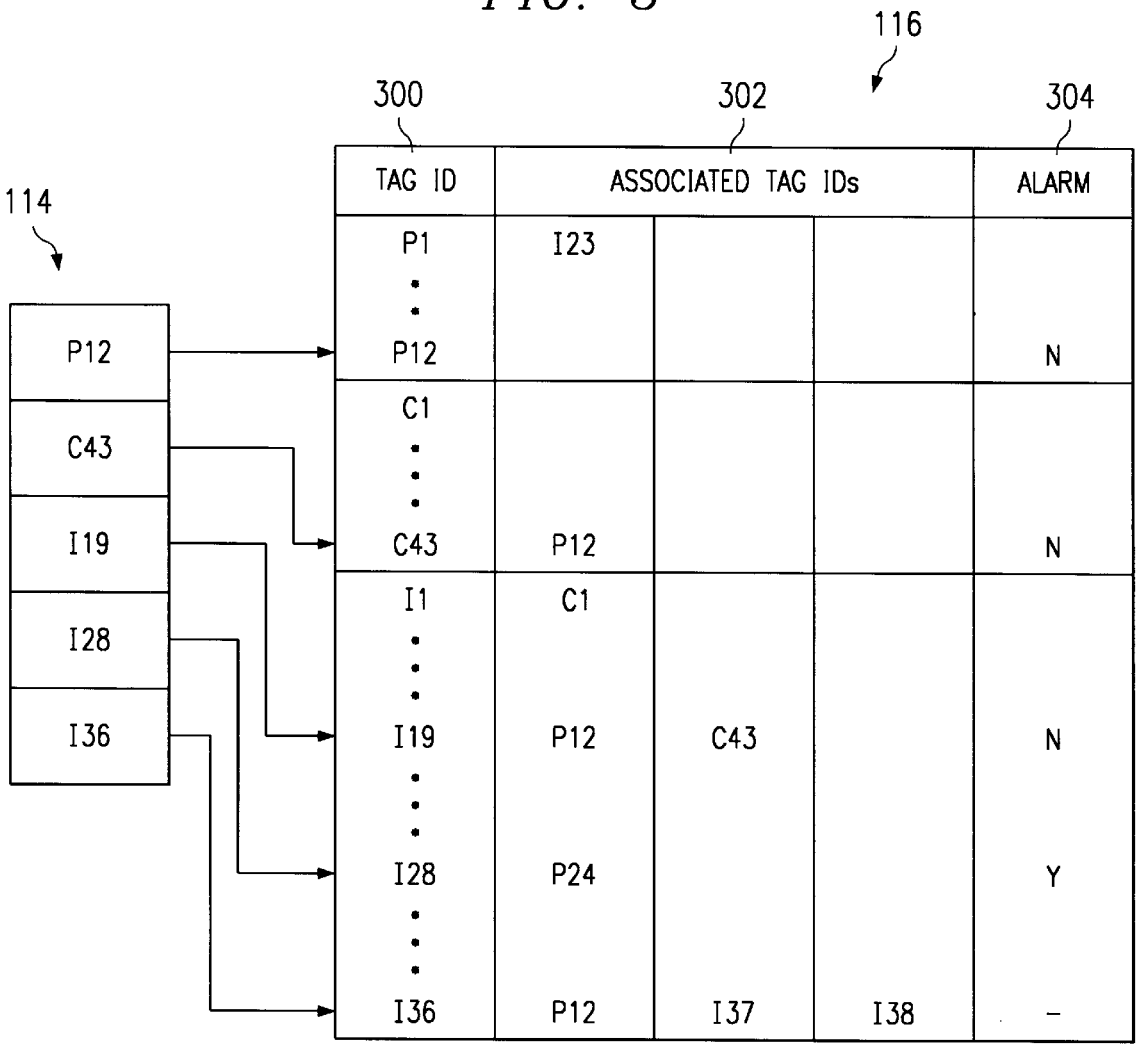
FIG. 5 illustrates exemplary data structures maintained by the security system to authorize item removal according to the present invention.

FIG. 5 illustrates in more detail the contents of tag ID list 114 stored in memory 108 and associated tag ID list 116 stored in database 110. In this particular embodiment, each tag ID 144 stored in lists 114 and 116 begins with a letter identifier that specifies whether tag ID 144 is associated with item 12 (I), person 14 (P), or container 50 (C). The letter identifier is then followed by a numeric designation to provide a distinctive tag ID 144 for tags 20, 22, and 56 in security system 10.

Tag ID list 114 contains those tag IDs 144 collected during an authorization event. These tag IDs 144 indicate the presence of one person (P12), one container (C43), and three items (I19, I28, I36) within the wireless operating range of base station 18. Associated tag ID list 116 includes columns for tag IDs 300, associated tag IDs 302, and alarm flags 304. Entries in associated tag ID list 116 are grouped by tags 22 for persons 14, tags 56 for containers 50, and tags 20 for items 12. Each tag ID 300 in an entry of associated tag ID list 116 can potentially include one or more associated tag IDs 302 that must be present to authorize removal of item 12, person 14, or container 50 identified by tag ID 300.

Normally, tag ID 300 associated with person 14 does not include associated tag IDs 302, as shown by tag ID P12. However, person 14 may require an escort, so tag ID 300 associated with person 14 may include associated tags 302 that identify one or more persons 14 serving as escorts. Tag ID 300 associated with container 50, such as tag ID C43, includes associated tag 302 (P12) that identifies person 14 authorized to transport container 50. In this case, container 50 may not exit the facility without being accompanied by person 14.

In most cases, tag ID 300 associated with item 12 includes at least one associated tag ID 302 that must be present to allow removal of item 12 from the facility. For example, tag ID I1 requires the presence of a container (C1); tag ID I19 requires the presence of a person (P12) and a container (C43); tag ID I28 requires the presence of a person (P24); and tag ID I36 requires the presence of a person (P12) and two other items (I37, I38).

In the particular example illustrated in FIG. 5, the first tag ID (P12) in tag ID list 114 does not include any associated tags 302 and is therefore authorized to exit the facility. This may be typical of an employee badge or identification card that allows exiting of employees, as long as the badge or identification card is authorized by security system 10. Consequently, base station 18 does not generate an alarm condition as indicated by alarm flag 304 set to "N".

The next tag ID (C43) in tag ID list 114 requires the presence of a person (P12). Since tag ID list 114 includes P12, base station 18 authorizes container 50 associated with tag ID C43 to exit the facility. The next tag ID (I19) in tag ID list 114 requires the presence of a person (P12) and a container (C43). Since tag ID list 114 includes both of these tag IDs, base station 18 authorizes item 12 associated with tag ID I19 to exit the facility.

The next tag ID (I28) in tag ID list 114 requires the presence of a person (P24), which is not confirmed by tag ID list 114. Consequently, base station 18 generates an alarm condition, as indicated by alarm flag 304 set to "Y". This causes the authorization event represented by tag ID list 114 to be unauthorized. In this example, if base station 18 detects that one item 12, person 14, and/or container 50 is unauthorized, then all items 12, persons 14, and containers 50 present during the authorization event are unauthorized. As such, it may not be necessary for base station 18 to further evaluate the authorization of the next tag ID (I36) in tag ID list 114.

Although the present invention has been described in several embodiments, a myriad of changes, variations, alterations, transformations, and modifications may be suggested to one skilled in the art, and it is intended that the present invention encompass such changes, variations, alterations, transformations, and modifications as fall within the spirit and scope of the appended claims.

What is claimed is:

1. A system for authorizing the removal of an item from a facility, comprising:

a first tag affixed to the item;

a second tag in proximity to the item;

a reader operable to read the first tag and the second tag; and a database coupled to the reader and operable to store tag identification information, the database further operable to indicate whether an association exists between the first tag and the second tag using the tag identification information and, if the association exists, to authorize the removal of the item from the facility.

2. The system of claim 1, wherein the second tag is associated with a person transporting the item.

3. The system of claim 1, wherein:

the first tag comprises a memory that stores a first tag ID associated with the first tag, and an antenna and a wireless interface operable to communicate the first tag ID;

the second tag comprises a memory that stores a second tag ID associated with the second tag, and an antenna and a wireless interface operable to communicate the second taa ID; and the reader comprises an antenna and a wireless interface coupled to the antenna, the wireless interface operable to receive the first tag ID and the second tag ID.

4. The system of claim 1, further comprising:

an exit from the facility; and a lock on the exit that is disabled if the database indicates an association between the first tag and the second tag.

5. A system for authorizing the removal of an item from a facility, comprising:

a first tag affixed to the item;

a second tag affixed to a container transporting the item;

a reader operable to read the first tag and the second tag; and a database coupled to the reader and operable to indicate whether an association exists between the first tag and the second tag and, if the association exists, to authorize the removal of the item from the facility.

6. A system for authorizing the removal of an item from a facility, comprising:

a first tag affixed to the item;

a second tag associated with a person transporting the item;

a third tag affixed to a container transporting the item;

a reader operable to read the first tag and the second tag; and a database coupled to the reader and operable to indicate an association between the first tag, the second tag, and the third tag to authorize the removal of the item from the facility.

7. A system for authorizing the removal of an item from a facility, comprising:

a first tag affixed to the item;

a second tag in proximity to the item;

a reader operable to read the first tag and the second tag within a predetermined time interval that defines an authorization event; and a database coupled to the reader and operable to indicate whether an association exists between the first tag and the second tag and, if the association exists, to authorize the removal of the item from the facility.

8. A system for authorizing the removal of an item from a facility, comprising:

a first tag affixed to the item;

a second tag in proximity to the item;

a reader operable to read the first tag and the second tag;

a database coupled to the reader; and an inventory control system coupled to the database, the inventory control system having an inventory interface operable to communicate information to the database using a communication network, wherein the information indicates an association between the first tag and the second tag to authorize the removal of the item from the facility.

9. A device for authorizing the removal of an item from a facility, comprising:

an antenna;

a wireless interface coupled to the antenna and operable to receive a first tag ID and a second tag ID, the first tag ID identifying a first tag affixed to the item;

a memory operable to store the first tag ID and the second tag ID;

a database operable to store an associated tag ID of the first tag ID; and a processor coupled to the memory and the database, the processor operable to authorize the removal of the item from the facility if the associated tag ID matches the second tag ID.

10. The device of claim 9, wherein the second tag ID identifies a second tag associated with a person transporting the item.

11. The device of claim 9, further comprising a lock driver coupled to the processor and operable to disable a lock on an exit to enable the removal of the item from the facility.

12. A device for authorizing the removal of an item from a facility, comprising:

an antenna;

a wireless interface coupled to the antenna and operable to receive a first tag ID and a second tag ID, the first tag ID identifying a first tag affixed to the item and the second tag ID identifying a second tag affixed to a container transporting the item;

a memory operable to store the first tag ID and the second tag ID;

a database operable to store an associated tag ID of the first tag ID; and a processor coupled to the memory and the database, the processor operable to authorize the removal of the item from the facility if the associated tag ID matches the second tag ID.

13. A device for authorizing the removal of an item from a facility, comprising:

an antenna;

a wireless interface coupled to the antenna and operable to receive a first tag ID and a second tag ID within a predetermined time interval that defines an authorization event, the first tag ID identifying a first tag affixed to the item;

a memory operable to store the first tag ID and the second tag ID;

a database operable to store an associated tag ID of the first tag ID; and a processor coupled to the memory and the database, the processor operable to authorize the removal of the item from the facility if the associated tag ID matches the second tag ID.

14. A device for authorizing the removal of an item from a facility, comprising:

an antenna;

a wireless interface coupled to the antenna and operable to receive a first tag ID and a second tag ID, the first tag ID identifying a first tag affixed to the item;

a memory operable to store the first tag ID and the second tag ID;

a database operable to store an associated tag ID of the first tag ID;

a processor coupled to the memory and the database, the processor operable to authorize the removal of the item from the facility if the associated tag ID matches the second tag ID; and a remote site interface operable to communicate the first tag ID and the second tag ID to a remote site if the associated tag ID does not match the second tag ID.

15. A method for authorizing the removal of an item from a facility, comprising:

receiving a first tag ID that identifies a first tag affixed to the item;

receiving a second tag ID;

retrieving an associated tag ID of the first tag ID; and authorizing the removal of the item if the associated tag ID matches the second tag ID.

16. The method of claim 15, wherein the second tag ID identifies a second tag associated with a person transporting the item.

17. The method of claim 15, further comprising the step of disabling a lock on an exit of the facility if the associated tag ID does not match the second tag ID.

18. A method for authorizing the removal of an item from a facility, comprising:

receiving a first tag ID that identifies a first tag affixed to the item;

receiving a second tag ID that identifies a second tag affixed to a container transporting the item;

retrieving an associated tag ID of the first tag ID; and authorizing the removal of the item if the associated tag ID matches the second tag ID.

19. A method for authorizing the removal of an item from a facility, comprising:

receiving a first tag ID that identifies a first tag affixed to the item;

receiving a second tag ID within a predetermined time interval of receiving the first tag ID;

retrieving an associated tag ID of the first tag ID; and authorizing the removal of the item if the associated tag ID matches the second tag ID.

20. A method for authorizing the removal of an item from a facility, comprising:

receiving a first tag ID that identifies a first tag affixed to the item;

receiving a second tag ID;

retrieving an associated tag ID of the first tag ID;

authorizing the removal of the item if the associated tag ID matches the second tag ID; and communicating the first tag ID and the second tag ID to a remote site if the associated tag ID does not match the second tag ID.

* * * * *